US010864421B2

(12) United States Patent
Burch

(10) Patent No.: US 10,864,421 B2
(45) **Date of Patent: *Dec. 15, 2020**

(54) GOLF PUTTING GAME AND ASSOCIATED SCORING METHODS

(71) Applicant: Thomas B. Burch, Banner Elk, NC (US)

(72) Inventor: Thomas B. Burch, Banner Elk, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/747,347

(22) Filed: Jan. 20, 2020

(65) Prior Publication Data

US 2020/0164256 A1 May 28, 2020

Related U.S. Application Data

(63) Continuation-in-part of application No. 15/817,299, filed on Nov. 20, 2017, which is a continuation of application No. 15/239,707, filed on Aug. 17, 2016, now abandoned.

(60) Provisional application No. 62/206,838, filed on Aug. 18, 2015.

(51) Int. Cl.

| | |
|---|---|
| ***A63B 67/02*** | (2006.01) |
| ***A63B 57/40*** | (2015.01) |
| ***A63B 71/06*** | (2006.01) |

(52) U.S. Cl.

CPC ..... *A63B 67/02* (2013.01); *A63B 57/40* (2015.10); *A63B 71/0605* (2013.01); *A63B 71/0622* (2013.01); *A63B 71/0669* (2013.01); *A63B 2225/74* (2020.08)

(58) Field of Classification Search

CPC ..... A63B 57/357; A63B 57/40; A63B 67/02; A63B 2207/02; A63B 2225/74

USPC ..... 473/150

See application file for complete search history.

(56) References Cited

U.S. PATENT DOCUMENTS

| | | | |
|---|---|---|---|
| 3,434,720 | A | 3/1969 | Hall |
| 4,053,155 | A | 10/1977 | Williams |
| 4,664,386 | A | 5/1987 | O'Neal, Jr. |
| 4,691,923 | A | 9/1987 | Schwartz |

(Continued)

OTHER PUBLICATIONS

Night Sports, Backyard LED Night Golf Pitch & Putt, Internet, Aug. 4, 2015, 5 pages.

(Continued)

*Primary Examiner* — Laura Davison

(74) *Attorney, Agent, or Firm* — Christopher C. Dremann, P.C.; Christopher C. Dremann

(57) ABSTRACT

A golf putting game includes at least one putting green defining a putting surface and a plurality of putting cups disposed within the putting surface at a different location on the putting green. Each putting cup has an exterior housing and an interior core disposed within and removably attached to the exterior housing. The interior core is removable from the exterior housing with the putting cup disposed within the putting surface of the putting green. The interior core of each putting cup may be illuminated by a visible light having a predetermined color and each putting cup may be assigned a predetermined number of base points corresponding to the predetermined color. A player score may be determined from a number of putting strokes made by a player to putt a putting ball into the putting cup and the predetermined number of base points assigned to the putting cup.

8 Claims, 8 Drawing Sheets

(56) References Cited

U.S. PATENT DOCUMENTS

| | | | | |
|---|---|---|---|---|
| 4,761,009 | A | 8/1988 | Gibree | |
| 5,016,884 | A | 5/1991 | Psiol | |
| 5,180,162 | A * | 1/1993 | Browne | A63B 57/357 473/176 |
| 5,390,925 | A * | 2/1995 | Wiltse | A63B 67/02 473/160 |
| 5,478,076 | A | 12/1995 | Dsjardins | |
| 5,688,182 | A | 11/1997 | Hill, Sr. | |
| 5,954,590 | A | 9/1999 | Nixey | |
| 6,110,053 | A * | 8/2000 | Sjoblom | A63B 57/40 473/179 |
| 7,594,859 | B2 | 9/2009 | Mullen | |
| 8,465,377 | B1 | 6/2013 | Kamnikar et al. | |
| 8,753,218 | B2 | 6/2014 | Suchanek | |
| 8,864,333 | B2 | 10/2014 | Burkart et al. | |
| 9,016,886 | B2 * | 4/2015 | Snyder | F21V 31/005 362/183 |
| 9,108,097 | B1 | 8/2015 | Rhone | |
| 9,415,283 | B2 | 8/2016 | Skurow et al. | |
| 10,537,774 | B1 * | 1/2020 | Burch | A63B 57/40 |
| 2003/0125122 | A1 | 7/2003 | Jolliffe et al. | |
| 2008/0026862 | A1 | 1/2008 | Rosen | |
| 2009/0054170 | A1 | 2/2009 | Probst | |
| 2009/0197691 | A1 | 8/2009 | Mullen | |
| 2009/0206759 | A1 | 8/2009 | Wang et al. | |
| 2010/0004068 | A1 | 1/2010 | Adame | |
| 2010/0160057 | A1 | 6/2010 | Willett | |
| 2011/0201437 | A1 | 8/2011 | Fallow et al. | |
| 2013/0210534 | A1 | 8/2013 | Suchanek | |
| 2013/0314906 | A1 | 11/2013 | Spinner | |
| 2014/0185278 | A1 | 7/2014 | Burkart et al. | |
| 2016/0252243 | A1 | 9/2016 | Garcia | |
| 2017/0014694 | A1 | 1/2017 | Skurow et al. | |
| 2017/0050095 | A1 | 2/2017 | Burch | |

OTHER PUBLICATIONS

Allison Doyle, American Golf, Golf Blog—Top 10 Golf Foursome Games, Internet, Apr. 4, 2013, 4 pages.

The International Bureau of WIPO, International Preliminary Report on Patentability (IPRP) and Written Opinion (WO) of the International Search Authority (ISA) for International Application No. PCT/US2016/047444, dated Feb. 20, 2018 (Feb. 20, 2018), 10 pages, Geneva, Switzerland.

* cited by examiner

GOLF PUTTING GAME AND ASSOCIATED SCORING METHODS

FIELD OF THE INVENTION

The present invention relates generally to sports and entertainment games and activities. More particularly, the invention is a golf putting game and methods of playing and scoring a golf putting game.

BACKGROUND OF THE INVENTION

The traditional game of golf involves driving a golf ball from a tee area onto a green and putting the golf ball into a cup positioned within a hole formed in the ground on the green. In most instances, one or more additional shots, also known as "strokes," are required between the tee and the green from a fairway, rough or hazard area, such as a sand trap. A complete game, or round, of the traditional golf game usually consists of eighteen (18) different tee and green combinations, each referred to as a "hole." A full round of traditional golf requires at least about three (3) hours, and often as much as four (4) or more hours, to play. Traditional golf is played for sport, entertainment, exercise and/or social purposes. In addition, traditional golf is oftentimes utilized as an opportunity to entertain existing and prospective business partners, clients and the like. Unfortunately, the amount of time that is typically required to complete a round of traditional golf has made the game less attractive for sport, recreation and business outings alike. Yet another limiting factor is the expense associated with traditional golf. The cost of equipment utilized to play traditional golf has increased dramatically as the technology of the game has advanced. At the same time, the cost to play a round of traditional golf has become prohibitive for many individuals and small businesses.

In response to the aforementioned concerns of time and expense, executive style golf has increased in popularity. A round of executive style golf usually consists of only nine (9) shorter-length holes. An executive style golf course is also referred to as a "par three" course since each hole is designed to ideally require only three shots, or strokes, to get the golf ball from the tee area onto the green and into the cup. Completing the hole in three strokes is referred to as making a "par" score. A par score is typically achieved by a single stroke, referred to as a "drive," to get the golf ball from the tee onto the green and two strokes using a putter, referred to as "putts," to get the golf ball into the cup on the green. For the foregoing reason, an executive style golf course is also known as a "drive and putt" or "pitch and putt" golf course. The amount of time required to play a round of executive style golf is significantly less than traditional golf due to the smaller number and shorter length of the holes, as well as the corresponding fewer number of shots that are typically needed to get the golf ball into the cup. The expense associated with executive style golf is also considerably less than traditional golf because less equipment is required to play. In addition, the cost of a round of executive style golf is usually lower than a round of traditional golf since the expense of establishing and maintaining an executive style golf course is significantly less than that of a traditional golf course.

Miniature golf is a sports and entertainment game and activity that provides a further reduction of time and expense compared to traditional golf and executive style golf. In addition, miniature golf provides an opportunity for a greater number of people to participate. A round of miniature golf usually consists of either nine (9) or eighteen (18) holes. However, each hole is essentially only a green with or without smaller sized obstacles and/or hazards, such as simulated water areas and sand traps. Accordingly, only putting strokes using a putter are required to play a round of miniature golf. As a result, the amount of time required to play a round of miniature golf is substantially less than either traditional golf or executive style golf. In addition, miniature golf does not require the amount of practice time and effort required to play traditional golf or executive style golf. Thus, miniature golf is available to be enjoyed by persons having various levels of experience, skill and ability. Typically, the putters and golf balls are provided by the operator of the miniature golf course. Thus, there is generally little or no expense to the players for the equipment required to play miniature golf. Furthermore, miniature golf courses do not require a large land area and are oftentimes constructed with artificial grass and features. Therefore, miniature golf courses are less expensive to build and require substantially less upkeep and maintenance to operate. Consequently, the cost to play a round of miniature golf is significantly less than the cost to play a round of traditional golf or executive style golf.

Despite its advantages of time, expense and opportunity, miniature golf has not become a widely accepted alternative to traditional golf and executive style golf. The most likely reason is that miniature golf is not perceived to involve a sufficiently high level of strategy or challenge, particularly for tournaments and competitive sporting events. It is therefore apparent a need exists for a sports and entertainment game and activity that overcomes the disadvantages and deficiencies of traditional golf, executive style golf and miniature golf. A more particular need exists for a golf game and activity that takes less time to complete than traditional golf or executive style golf. A further particular need exists for a golf game and activity that is less expensive to play than traditional golf or executive style golf. A still further need exists for a golf game and activity that is readily available to people of various levels of experience, skill and ability. Regardless, a need exists for a golf game an activity that is suitable for recreational and business outings, yet at the same time is more challenging for tournaments and competitive sporting events than miniature golf. In addition, a novel and unique method of playing and scoring a golf game and activity is needed.

Certain aspects, objects, features and advantages of the present invention will be made apparent, or will be readily understood and appreciated by those skilled in the relevant art, by the exemplary embodiments of the invention described in greater detail hereafter and illustrated in the accompanying drawing figures. It is intended that all such aspects, objects, features and advantages of the invention envisioned by this disclosure of exemplary embodiments be encompassed by the scope of protection of the appended claims, given their broadest reasonable construction and interpretation in view of any relevant prior art. These aspects, objects, features and advantages of the invention, as well as others not expressly disclosed, may be accomplished by any of the exemplary embodiments described herein and illustrated in the accompanying drawing figures. However, it should be appreciated that the drawing figures are for illustrative purposes only, and that many modifications, changes, revisions and substitutions may be made to any of the exemplary embodiments without departing from the general concepts of the invention as they may be broadly construed and interpreted.

SUMMARY OF THE INVENTION

In one aspect, the present invention is embodied by a golf putting game that includes at least one putting green defining a putting surface and a plurality of putting cups with each putting cup disposed within the putting surface at a different location on the putting surface of the putting green. Each putting cup has an exterior housing and an interior core that is disposed within the exterior housing and removably attached to the exterior housing. The interior core is removable from the exterior housing with the putting cup disposed within the putting surface of the putting green. The interior core may be illuminated by a visible light having a predetermined color. The interior core may include a printed circuit board (PCB) and at least one battery electrically coupled to the PCB. The PCB may have at least one source of visible light electrically coupled to the PCB for illuminating the interior core of the putting cup. The source of visible light may be a light-emitting-diode (LED). The battery may be a rechargeable battery, such as a lithium polymer rechargeable battery. The exterior housing may have a first receiver and the interior core may have a second receiver, and the interior core may be removably attached to the exterior housing when the second receiver is engaged with the first receiver. The interior core may have a base and a cover, and at least the cover may be made of a material that is at least translucent. The golf putting game further includes a putting club and a putting ball configured to be struck by the putting club. The putting ball is received within the putting cup when the putting ball is struck with one or more putting strokes of the putting club. In one embodiment, each of the putting cups disposed within the putting surface is illuminated with a visible light having a different color and is assigned a predetermined number of base points corresponding to the color of the putting cup.

In another aspect, the present invention is embodied by a golf putting game including at least one putting green defining a putting surface and a plurality of putting cups with each putting cup disposed within the putting surface at a different location on the putting surface of the putting green. Each putting cup has an interior core that is removably attached to an exterior housing. The interior core is removable from the exterior housing with the putting cup disposed within the putting surface of the putting green. Each putting cup is assigned a predetermined number of base points for scoring the golf putting game. In one embodiment, the plurality of putting cups includes five (5) putting cups that are assigned ten (10) base points, eight (8) base points, six (6) base points, four (4) base points and two (2) base points, respectively. A player score is determined from a number of putting strokes made by a player to putt a putting ball into a putting cup and the predetermined number of base points assigned to the putting cup.

In yet another aspect, the present invention is embodied by a method of playing a golf putting game. The method includes providing at least one putting green defining a putting surface and providing a plurality of putting cups with each putting cup positioned at a different location on the putting surface of the putting green. The method further includes providing a putting club and a putting ball to a player of the golf putting game. The method further includes the player selecting one of the putting cups into which the player will attempt to putt the putting ball. The method further includes the player making at least one putting stroke using the putting club to putt the putting ball into the one of the putting cups selected by the player. In another embodiment, the method further includes illuminating at least one of the plurality of putting cups with a visible light. In yet another embodiment, the method further includes illuminating each of the plurality of putting cups with a visible light having a different color.

In yet another aspect, the present invention is embodied by a method of scoring a golf putting game. The method includes providing at least one putting green defining a putting surface and providing a plurality of putting cups with each putting cup positioned at a different location on the putting surface of the putting green. The method further includes providing a putting club and a putting ball to a player of the golf putting game. The method further includes assigning a predetermined number of base points to each of the plurality of putting cups. The method further includes calculating a player score based on the predetermined number of base points assigned to one of the putting cups. In another embodiment, calculating the player score further includes multiplying the predetermined number of base points assigned to one of the putting cups by a number of putting strokes. In yet another embodiment, the number of putting strokes corresponds to a number of putting strokes made by the player to putt the putting ball into the one of the putting cups.

BRIEF DESCRIPTION OF THE DRAWINGS

The aforementioned aspects, objects, features and advantages of the present invention will be more fully understood and appreciated when considered in conjunction with the accompanying drawing figures, in which like reference characters designate the same or similar parts throughout the several views.

DETAILED DESCRIPTION OF EXEMPLARY EMBODIMENTS OF THE INVENTION

Various exemplary embodiments of a golf putting game and methods of playing and scoring the golf putting game according to the present invention are described in greater detail hereafter and illustrated in the accompanying drawing figures. The golf putting game of the present invention is commercially known as "HiLo" due to the unique combination of strategy and skill available for playing and scoring the game. More specifically, HiLo combines the strategy of high points scoring with the skill of a low number of golf putting stokes. HiLo is designed to be a less time consuming, more affordable and practical alternative to traditional golf, executive style golf and miniature golf, while at the same time providing enjoyment and challenge to persons having various levels of experience, skill and ability. The HiLo golf putting game utilizes a unique scoring system that allows players to select a level of difficulty of a particular putting cup on the putting green of each hole, and thereby execute a strategy for maximizing his or her score based on the player's putting ability. As a result, players having different levels of experience, skill and ability are able to compete with one another at the same time and on the same course in an enjoyable and challenging manner.

Figure 1:
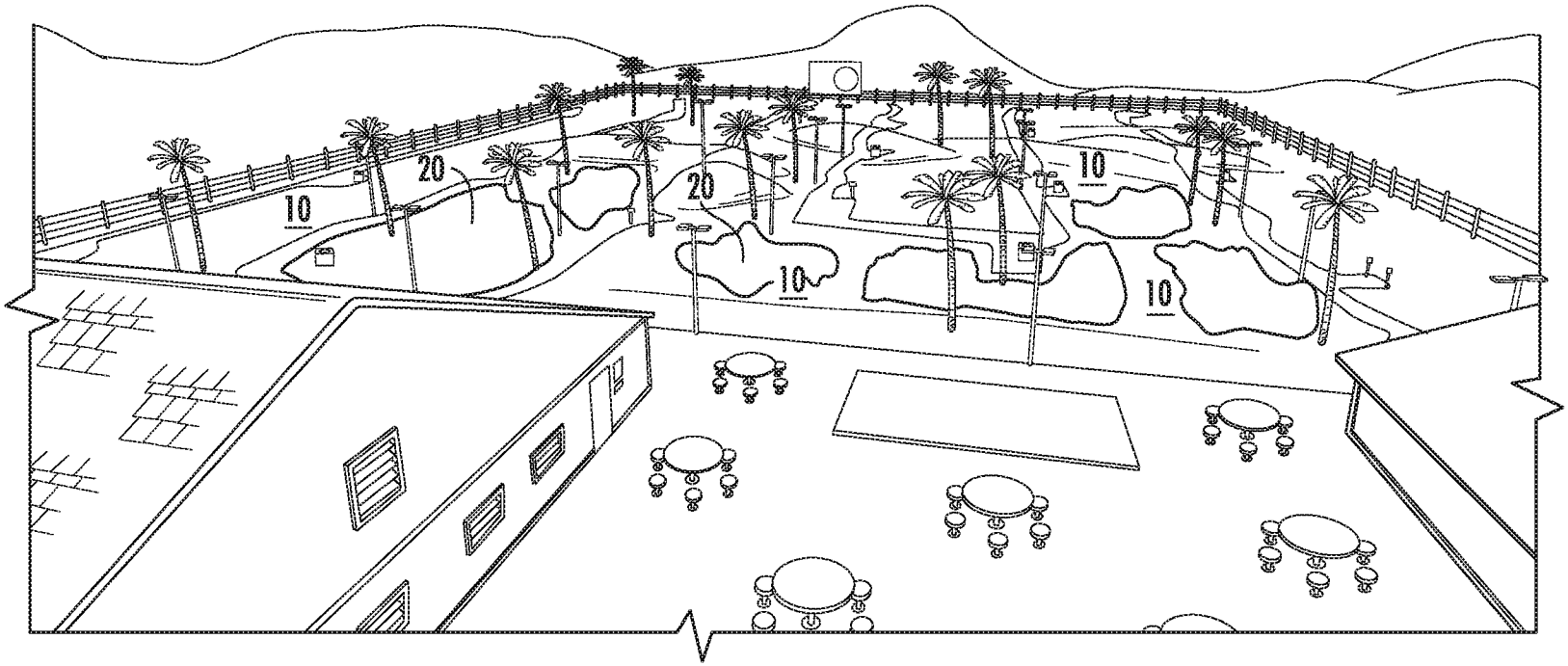
FIG. 1 is a perspective view illustrating a golf putting game according to an exemplary embodiment of the present invention.

FIG. 1 shows a golf putting game according to an exemplary embodiment of the present invention referred to herein as "HiLo". The HiLo golf putting game consists at least one, and preferably, a plurality of holes 10 with each hole typically having a corresponding putting green 20, also referred to herein merely as a "green." However, if desired, two or more of the holes 10 may utilize the same putting green 20. A complete game, or round, of HiLo may consist of any desired number of holes 10. By way of example, the HiLo golf putting game preferably comprises at least about nine (9) holes 10, but not more than about thirty-six (36) holes 10. In a particularly advantageous embodiment that will be described in greater detail herein, the HiLo golf putting game consists of twenty (20) different holes 10 with each hole comprising a corresponding putting green 20 defined by a periphery, perimeter, outer boundary or the like 22 (see FIG. 2). Consequently, each hole 10 requires only the use of a putting club (not shown) and a putting ball 23 (see FIG. 8). If desired, the putting club and the putting ball 23 may be a conventional golf putter and conventional golf ball for use in a known manner. Alternatively, a putting club and/or a putting ball 23 may be provided that is unique to the HiLo golf putting game. By way of example and not limitation, the putting club may have any desired configuration including a putting head of any desired size and shape suitable for striking, referred to as "putting," the putting ball 23 on the putting green 20. Likewise, the putting ball 23 may have any desired configuration. By way of example and not limitation, the putting ball 23 may be larger or smaller in circumference than a conventional golf ball. Furthermore, the putting ball 23 may include one or more sources of visible light 72 (see FIG. 9), such as light-emitting-diodes (LEDs), for illuminating the putting ball 23 to enhance the aesthetics of the golf putting game and/or to facilitate playing the golf putting game in relatively low ambient light conditions, such as is typically encountered with nighttime play.

Figure 2:
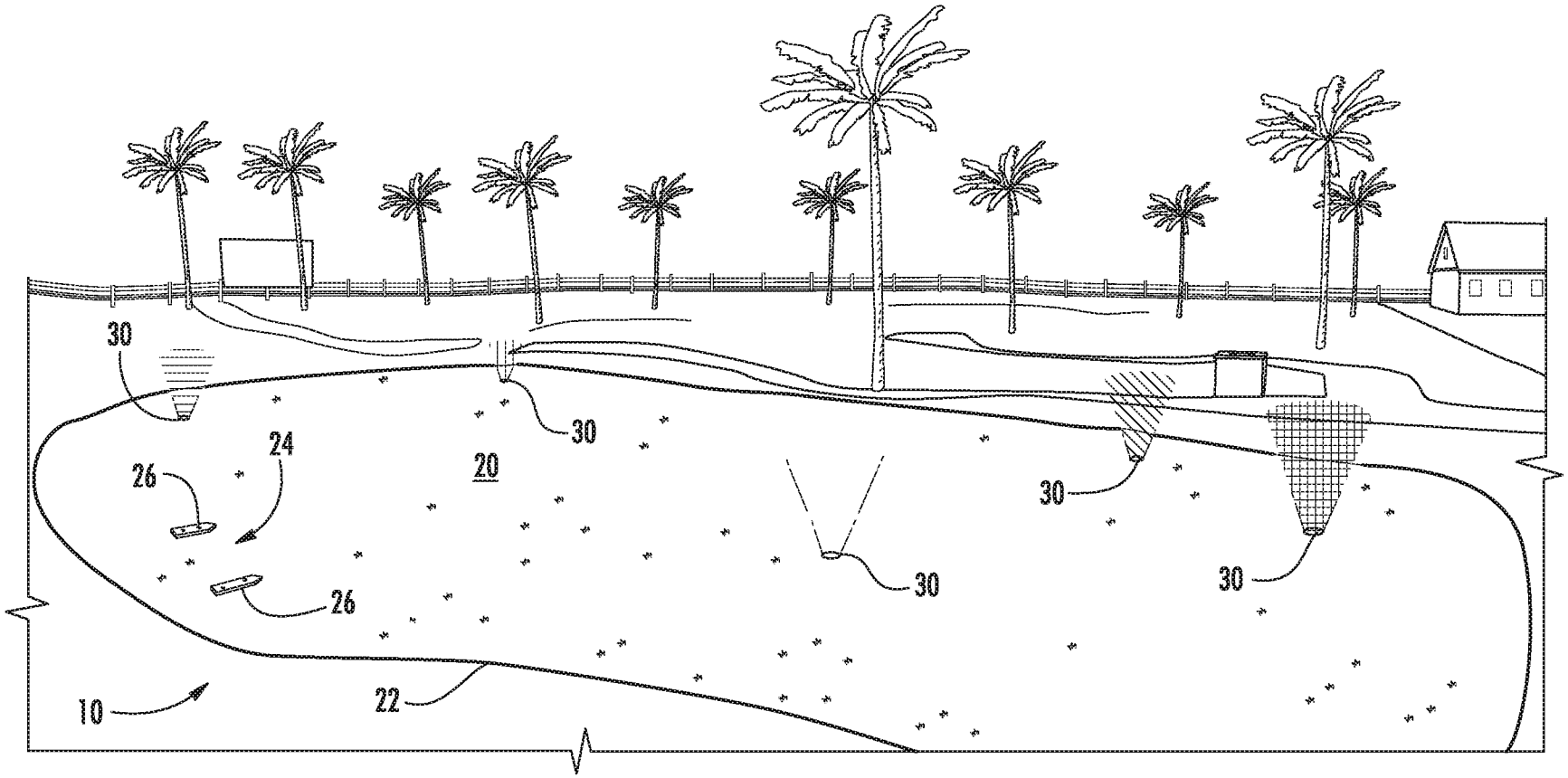
FIG. 2 is a perspective view of a putting green of a typical hole of the golf putting game of FIG. 1 showing a plurality of putting cups positioned at different locations on the putting green.
Figure 3:
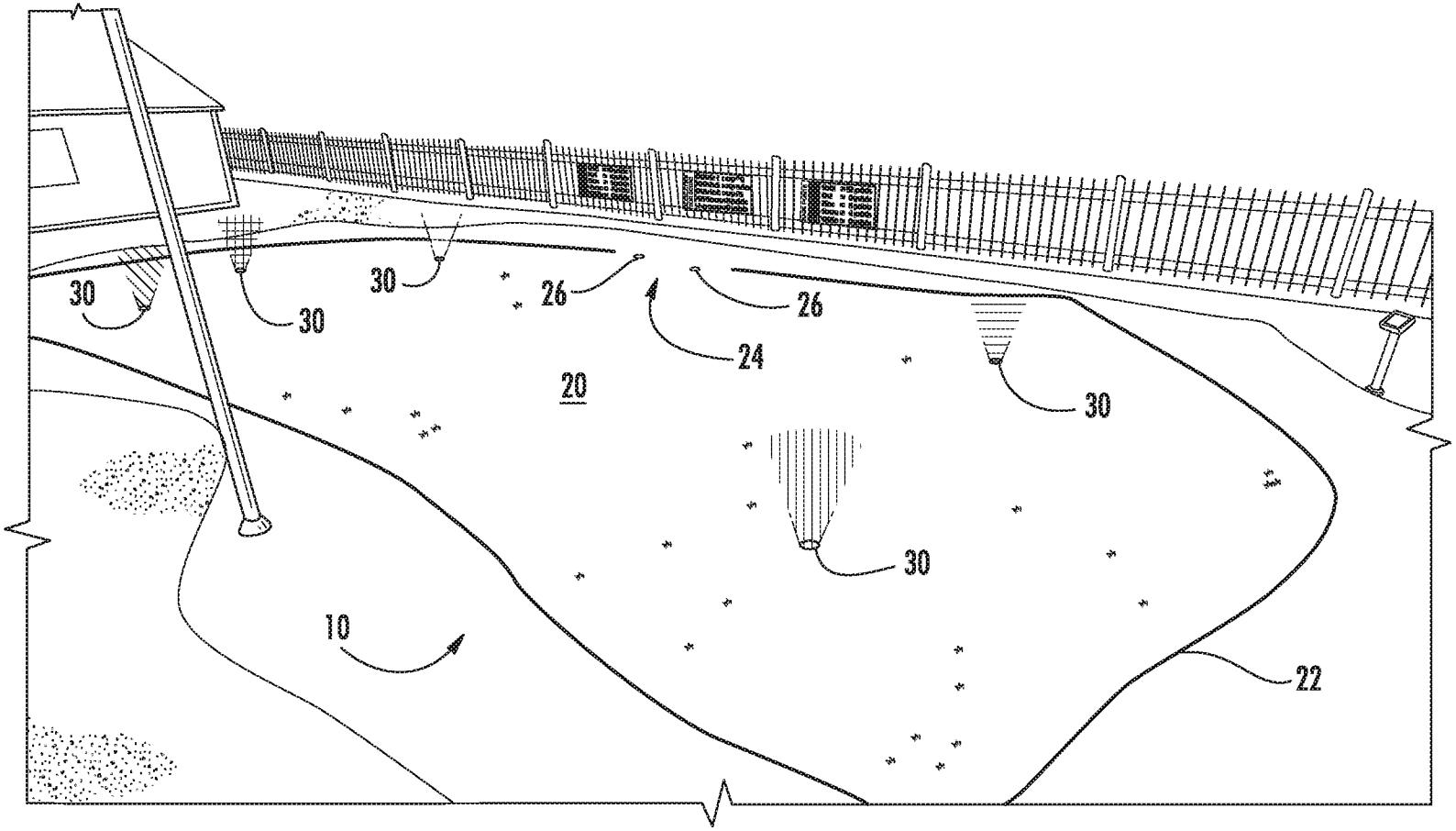
FIG. 3 is another perspective view of the putting green of the hole of the golf putting game of FIG. 2 showing the plurality of putting cups as viewed from the opposite side of the putting green.

FIG. 2 shows a typical putting green 20 of a hole 10 for the golf putting game of FIG. 1. FIG. 3 shows the typical putting green 20 from the perspective of the opposite side of the putting green 20. Like traditional golf, executive style golf and miniature golf, the putting green 20 of each hole 10 includes a designated starting area 24, commonly referred to as a "tee area" or "tee box." However, since only a putting club is used in the HiLo golf putting game, the designated starting area 24 may be referred to as a "putting box" instead of or in addition to a "tee box." If desired, the lateral boundaries of the putting box 24 may be defined by one or more, and preferably by a pair, of spaced-apart markers 26, commonly referred to as "tee markers," or alternatively referred to as "putting markers" for the purpose of the HiLo golf putting game. Unlike traditional golf, executive style golf and miniature golf, each hole 10 of the HiLo golf putting game includes a plurality of putting cups 30 positioned at different locations on the surface of each putting green 20. Each of the plurality of putting cups 30, also referred to herein merely as cups 30, is configured (i.e., sized and shaped) to suitably receive the putting ball 23 in a conventional manner (see FIG. 8). More specifically, each putting cup 30 has a sufficient diameter and depth to capture and retain the putting ball 23 therein when the putting ball 23 is struck (putted) by the putting club into the putting cup 30. The plurality of cups 30 on each putting green 20 may have the same configuration, or if desired, may have one or more different configurations. By way of example and not limitation, the putting cups 30 on each putting green 20 may have different diameters for the purpose of requiring a variable level of skill and ability to successfully guide the putting ball 23 into the putting cup 30, thereby introducing an additional level of strategy and skill to the golf putting game, as will be described in greater detail hereinafter.

In the exemplary embodiments depicted in FIG. 2 and FIG. 3, the putting green 20 has a total of five (5) different putting cups 30. Each of the putting cups 30 is positioned at a discrete different location relative to the putting box 24. Preferably, each cup 30 is positioned on the green 20 at a different location that requires a unique level of skill and/or ability to putt the putting ball 23 into the putting cup 30 from the putting box 24. The unique level of skill and/or ability may, for example, be due to the distance of the putting cup 30 from the putting box 24. Alternatively, the level of skill and ability required to putt the putting ball 23 into the putting cup 30 may result from undulations or other natural obstructions formed in the surface of the putting green 20. If desired, the putting cups 30 may be identified by conventional alphanumeric characters, for example numbers, such as 1-5, or letters, such as A-E. Alternatively, the putting cups 30 on each putting green 20 may be identified by a combination of alphanumeric characters, for example a number indicating the hole 10 of the golf putting game and a letter indicating the particular putting cup 30 of the putting green 20 of the hole 10. By way of example and not limitation, the putting green 20 and the putting cup 30 for the twenty (20) holes 10 of the golf putting game may be identified with alphanumeric characters from 1A-1E up to and including 20A-20E. The alphanumeric characters may be assigned to a corresponding putting cup 30 in any suitable manner, for example by painting the identifier on the surface of the green 20 adjacent to the corresponding cup 30, or alternatively or in addition, by printing the identifier on a flag attached to a flagstick that is placed within the putting cup 30. In a preferred embodiment, however, each putting cup 30 on each putting green 20 is identified by a unique color, as described next, with or without a corresponding flagstick and flag.

In a particularly advantageous embodiment, each cup 30 on each green 20 is associated with and identified by a different color. By way of example and not limitation, each cup 30 may be painted with a preselected color. Alternatively or in addition, each putting cup 30 may be illuminated with a preselected color of visible light. In a preferred embodiment, each putting cup 30 is provided with one or more light-emitting-diodes (LEDs) that illuminate the putting cup 30, and hence, the area above the putting cup 30 with a preselected color of visible light. In addition to indicating the location of a putting cup 30 on the surface of the putting green 20, illuminating each cup 20 on each green 30 enhances the aesthetics of the HiLo golf putting game and facilitates play in relatively low ambient light conditions, such as is typically encountered with nighttime play. In another embodiment, the putting cup 30 may be provided with a contact sensor, impact sensor, vibration sensor or the like operable for determining that a putting ball 23 has been received within the putting cup 30. In addition, the putting cup 30 may comprise a control circuit and a timer operably coupled with the aforementioned sensor and configured for cycling the illumination (e.g., flashing) of the putting cup 30 for a desired period of time to thereby indicate a successful putt and completion of a hole 10 of the HiLo golf putting game by a particular player.

Figure 4:
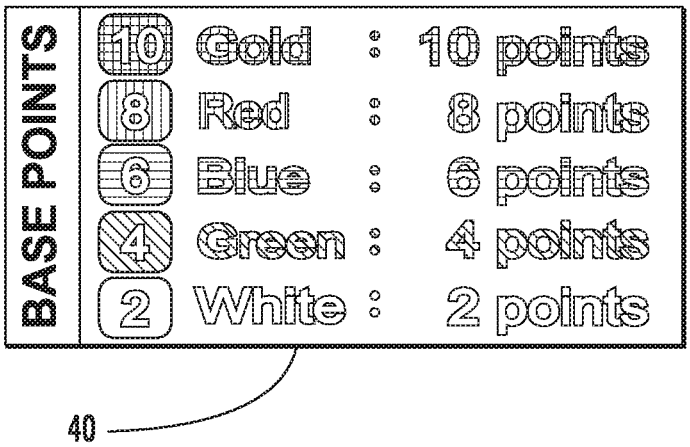
FIG. 4 shows a chart listing a predetermined number of base points corresponding to each of the plurality of putting cups positioned at different locations on a putting green of a hole of a golf putting game according to an exemplary embodiment of the present invention.

In a particularly advantageous embodiment, the putting cups 30 on each putting green 20 of each hole 10 are illuminated with a preselected color of visible light that corresponds to a predetermined number of base points for scoring the HiLo golf putting game. The predetermined number of base points corresponding to a particular putting cup 30 is also referred to herein as the "value" of the putting cup in the HiLo golf putting game. FIG. 4 shows a chart 40 that lists the predetermined number of base points for each of the putting cups 30 on each putting green 20 of the HiLo golf putting game. By way of example and not limitation, the putting cup 30 requiring the greatest amount of skill and/or ability to putt the putting ball 23 into the cup 30 is illuminated with visible light having the color gold, and is assigned a value of ten (10) base points. The putting cup 30 on each putting green 20 requiring the next greatest amount of skill and/or ability is illuminated with visible light having the color red, and is assigned a value of eight (8) base points. Similarly, the next most difficult putting cup 30 on each putting green 20 is illuminated with visible light having the color blue, and is assigned a value of six (6) base points. The next most difficult putting cup 30 on each putting green 20 is illuminated with visible light having the color green, and is assigned a value of four (4) base points. Finally, the putting cup 30 on each putting green 20 that requires the least amount of skill and/or ability to putt the putting ball 23 into the cup 30 is illuminated with visible light having the color white, and is assigned a value of only two (2) base points.

Figure 5:
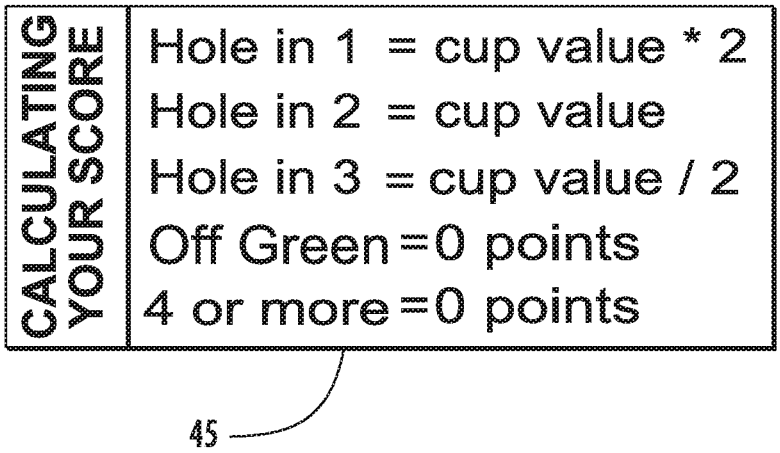
FIG. 5 shows a chart illustrating a method for calculating a player score using the predetermined number of base points listed in FIG. 4 according to an exemplary embodiment of the present invention.

FIG. 5 shows a chart 45 that illustrates a method for calculating a player score using the predetermined number of base points listed in FIG. 4 according to an exemplary embodiment of a method of scoring a golf putting game according to the present invention. As illustrated in FIG. 5, putting the putting ball 23 into a putting cup 30 in a single putting stroke (referred to herein as a "Hole in 1") results in a player score of the predetermined number of base points assigned to the putting cup multiplied by two (2). For purposes of the HiLo golf putting game, the predetermined number of base points is also referred to as the "cup value." By way of example and not limitation, if a player selects the putting cup 30 illuminated with visible light having the color red (indicated in FIGS. 2-4 with vertical lines) and the player makes a Hole in 1, the player score for the hole 10 is calculated as the cup value corresponding to the red putting cup (i.e. 8 base points) multiplied by two (2). Consequently, the player score for that hole 10 is equal to eight (8) base points multiplied by two (2) for a total of sixteen (16) points. Alternatively, if a player selects the white putting cup 30 (indicated in FIGS. 2-4 with no lines) and the player makes a hole in 1, the player score is calculated as the cup value (2 base points) multiplied by two (2) for a total of four (4) points. However, if a player needs 2 putting strokes to putt the putting ball 23 into a putting cup 30 (shown in FIG. 5 and referred to herein as a "Hole in 2"), the player score is equal to the cup value assigned to that putting cup 30. For example, a player that selects the putting cup 30 illuminated with visible light having the color gold and makes a Hole in 2 receives a player score of ten (10) points for that hole 10. Similarly, a player making a Hole in 2 into the green putting cup 30 receives a player score of only four (4) points. For purposes of the HiLo golf putting game, a Hole in 2 resulting in the cup value of the putting cup 30 selected by the player is considered to be a "par" score.

In the event that a player requires three (3) putting strokes to putt the putting ball 23 into a putting cup 30 (shown in FIG. 5 and referred to herein as a "Hole in 3"), the player score is calculated by dividing the cup value of the putting cup 30 by two (2). By way of example and not limitation, selecting the putting cup 30 illuminated with visible light having the color blue and making a Hole in 3 results in a player score of six (6) base points divided by two (2) for a total of three (3) points for that hole 10. On the other hand, a player that makes a Hole in 3 into the putting cup 30 illuminated with visible light having the color gold receives a player score of ten (10) base points divided by two (2) for a total of five (5) points. If a player putts the putting ball 23 off of the surface of the putting green 20, or alternatively, requires four (4) or more putting strokes to putt the putting ball 23 into a putting cup 30, a player score of zero (0) points is received by the player for that hole 10 of the HiLo golf putting game.

In one embodiment of a method of scoring a golf putting game according to the present invention, a player score for the first hole 10 of the golf putting game is calculated as described hereinabove and recorded in any suitable manner, such as manually on a conventional scorecard. The player score for each successive hole 10 of the golf putting game is calculated and recorded in the same or similar manner. If desired, the player score for each successive hole 10 may be added to the previous player score to determine a running player score for the player. When all of the holes 10 of the golf putting game have been completed, for example twenty (20) holes 10, the total player score for each player is determined by combining the player score for each of the holes 10, and the player with the highest total player score is the winner of that round of the golf putting game. With respect to the unique methods of playing and scoring the HiLo golf putting game described and illustrated herein, the player having the highest total player score may also be the player having the lowest number of putting strokes. However, depending on the strategy employed by players of various levels of experience, skill and ability, the player having the highest total player score may not be the player that required the lowest number of putting strokes to complete that round of the HiLo golf putting game.

If desired, the HiLo golf putting game may include one or more score modifiers to increase the strategy employed by players of various levels of experience, skill and ability. In one embodiment, the HiLo golf putting game includes one or more wild cups. The wild cup(s) may be a preselected putting cup 30 of a particular color on one or more of the putting greens 20, or alternatively, may be one or more putting cups 30 that are selected at random, or in a random manner. By way of example and not limitation, an official of the HiLo golf putting game may announce at any time during a round of the golf putting game that a particular putting cup 30, for example the putting cup 30 illuminated with visible light having a blue color (i.e., "the blue cup"), is the wild cup. Regardless, each wild cup provides a player with the opportunity to obtain an enhanced player score for the corresponding hole 10 or holes 10. By way of example and not limitation, if a player selects the putting cup 30 that is the wild cup and makes a Hole in 1, the player may receive a player score equal to twenty (20) total points for that hole 10. However, if the player fails to make a Hole in 1, the player receives a player score of zero (0) points for that hole 10. Alternatively, if desired, the player score calculated in the manner described hereinabove may be doubled in the event that the player selects the putting cup 30 that is designated to be the wild cup.

In yet another embodiment, each player may be provided with one or more optional opportunities to obtain an enhanced player score for one or more holes 10 of the HiLo golf putting game. By way of example and not limitation, each player may be provided with an opportunity during a round of the HiLo golf putting game to enhance their player score at a predetermined or randomly determined hole 10 by designating a particular putting cup 30 to be a wild cup, and then making a Hole in 1 in that putting cup 30. For example, a player may select the putting cup 30 illuminated with a white visible light on a particular hole 10 to be a wild cup. If the player makes a Hole in 1 in the wild cup selected by the player for that hole 10 (i.e., the white putting cup 30), the player receives a player score of twenty (20) points for that hole 10. However, if the player fails to make a Hole in 1, the player receives a player score of zero (0) points for that hole 10. In this manner, a player may strategically increase their total player score during a round of the HiLo golf putting game. On the other hand, a player may elect to forgo the opportunity to increase their total player score and rely instead on the aforementioned standard means for calculating a player score for that hole 10. In a particular embodiment, each player is provided with two opportunities to select a wild cup on the putting green 20 of two different holes 10 in an effort to increase their total player score. This optional modification to the standard HiLo golf putting game is commercially referred to as "deuces wild."

Figure 6:
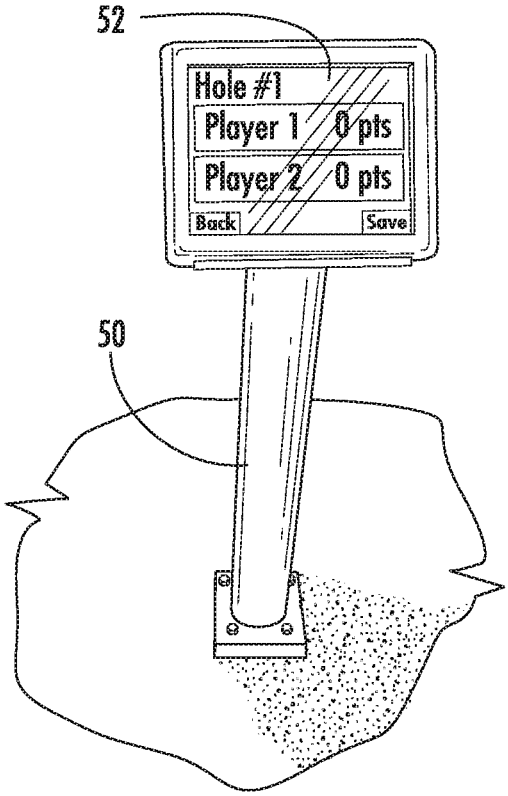
FIG. 6 is a perspective view of a typical kiosk configured for use with a golf putting game according to an exemplary embodiment of the present invention.

FIG. 6 shows an exemplary embodiment of a typical kiosk 50 configured for use with a golf putting game according to the present invention. More particularly, the kiosk 50 is configured for use with the HiLo golf putting game shown and described herein. In one embodiment, each player is provided with a HiLo identification card operable for use with the kiosk 50. The HiLo identification card may include magnetic media (e.g., a magnetic stripe or strip) or transmission media (e.g., radio frequency transmission capability, such as "near field communication (NFC), "Bluetooth" or the like) for communication with the kiosk 50. Alternatively, the identification card may include an identification code that can be manually input to the kiosk 50 via a keyboard, keypad, touch screen or the equivalent. Regardless, the identification card identifies the player and associates the player with data input, recorded and stored by the kiosk for use in conjunction with the HiLo golf putting game. In one embodiment, the kiosk 50 identifies the player from the identification card and displays information relating to the player and the HiLo golf putting game on a display screen 52 of the kiosk 50. For example, the kiosk may display the hole 10 of the HiLo golf putting game the player is about to play, and in addition or alternatively, the player score for the previous hole 10 and/or the running total player score for the current round of the HiLo golf putting game.

Figure 7:
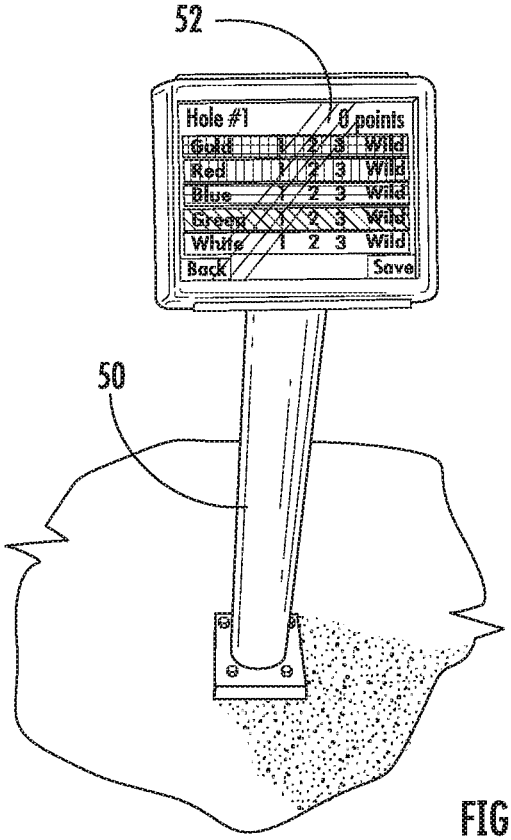
FIG. 7 is another perspective view of the kiosk of FIG. 6 illustrating a method for recording a player score according to an exemplary embodiment of the present invention.

FIG. 7 shows the kiosk 50 and illustrates a method of using the kiosk to record a player score for the HiLo golf putting game according to an exemplary embodiment of the present invention. By way of example and not limitation, the display screen 52 of the kiosk 50 is configured as a conventional touch screen and a player enters their player score by selecting the color of the putting cup 30 and the number of putting strokes (1, 2 or 3) made by the player to putt the putting ball 23 into the putting cup of a particular hole 10. In the example illustrated in FIG. 7, the kiosk 50 is used to input the player score for the hole 10 number one (#1) of the HiLo golf putting game. First, the color (i.e., gold, red, blue, green or white) of the putting cup 30 for the hole 10 #1 is selected from the display screen 52, via for example a touch screen, and input into the player account stored on the kiosk. Next, the number of putting strokes that the player made to putt the putting ball 23 into the putting cup 30 (i.e. 1, 2 or 3) is selected from the display screen 52, via for example the touch screen, and input into the player account stored on the kiosk 50. By way of example and not limitation, if the player made a Hole in 2 (two putting strokes) into the putting cup 30 illuminated with visible light having the color green, the player selects the line indicating the green putting cup and then selects the number indicating two (2) putting strokes. The kiosk 50 then calculates a player score of four (4) points corresponding to a "par" for the putting cup 30 having a predetermined number of base points, or cup value, equal to four (4).

The kiosk 50 may then display the player score of four (4) points for the hole 10 on the display screen 52 and/or the running (total) player score for the round of the HiLo golf putting game. If applicable, the kiosk 50 may also include a "WILD" indicator on the display screen 52. If the player selected a putting cup 30 designated or selected to be a wild cup, the player selects the WILD indicator on the display screen 52 and then selects the number of putting strokes made by the player, which indicates whether or not the player made a Hole in 1. The kiosk 50 then calculates, records and displays on the display screen 52 either a player score of twenty (20) points or zero (0) points for the corresponding hole 10. In another embodiment, the kiosk 50 may be operable for allowing a player to compare his or her player score to a previously recorded player score. In this manner, the player can play a round of the HiLo golf putting game against his or her prior score, or alternatively, against a previously recorded player score of a real or fictitious (virtual) player. In still another embodiment, the kiosk 50 may be configured to display player statistics on the display screen 52 and/or to allow the player to purchase an additional round of the HiLo golf putting game and/or HiLo merchandise to be charged to a credit card or account associated with the identification card assigned to the player.

Figure 8:
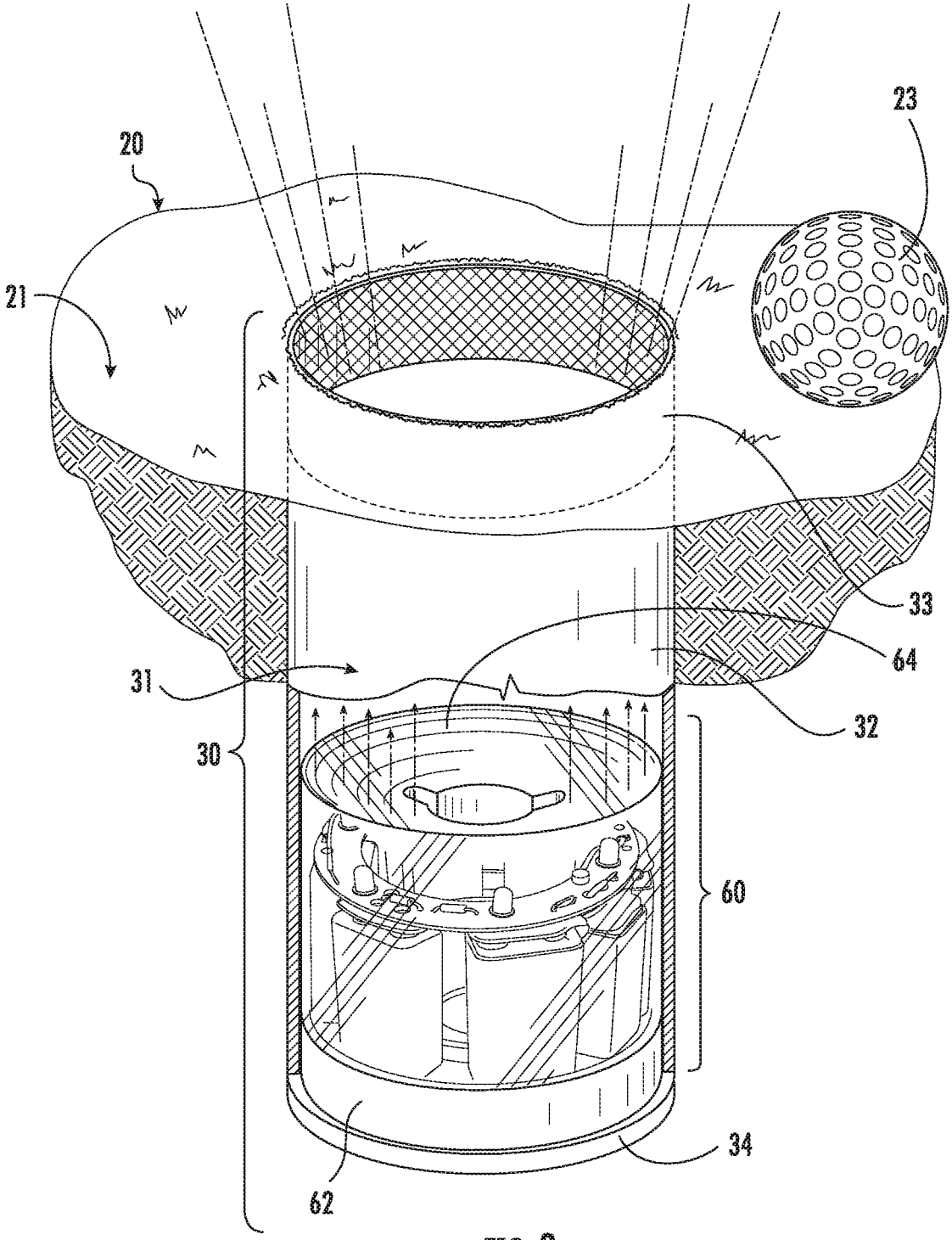
FIG. 8 is a perspective view of a putting cup configured for use with a golf putting game according to an exemplary embodiment of the present invention.

FIG. 8 is a perspective view of a putting cup 30 configured for use with a golf putting game according to an exemplary embodiment of the present invention. The perspective view of FIG. 8 shows the putting cup 30 with a portion of an exterior housing, indicated generally by reference character 31, broken away to show an interior core, indicated generally by reference character 60. As shown in the illustrated embodiment, the exterior housing 31 is configured in the form of a generally cylindrical, hollow sleeve. The putting cup 30 is disposed within a recess formed in a putting green 20. By way of example, the putting green 20 may be a putting green of a hole of a traditional golf game or an executive style golf game. Alternatively, the putting green 20 may be a putting green of a hole of a miniature golf game. For purposes of the present disclosure, the putting green 20 is a putting green of a hole 10 of the golf putting game described herein. The exterior housing 31 may be disposed directly within a recess formed in a putting green 20 having a putting surface 21 formed of a natural grass suitable for putting a putting ball 23. Alternatively, the exterior housing 31 may be disposed within an outer receptacle (not shown) having an inner diameter sized to receive the exterior housing 31 that is recessed into a putting green 20 having a putting surface 21 formed of an artificial turf suitable for putting a putting ball 23. In either instance, the entire putting cup 30 may be removed from the recess or from the outer receptacle, and replaced with a different putting cup 30 or moved to another location on the putting green 20. Preferably, however, the interior core 60 is removably disposed within the exterior housing 31, and only the interior core 60 is removed and replaced, as will be described in greater detail hereafter.

Figure 9:
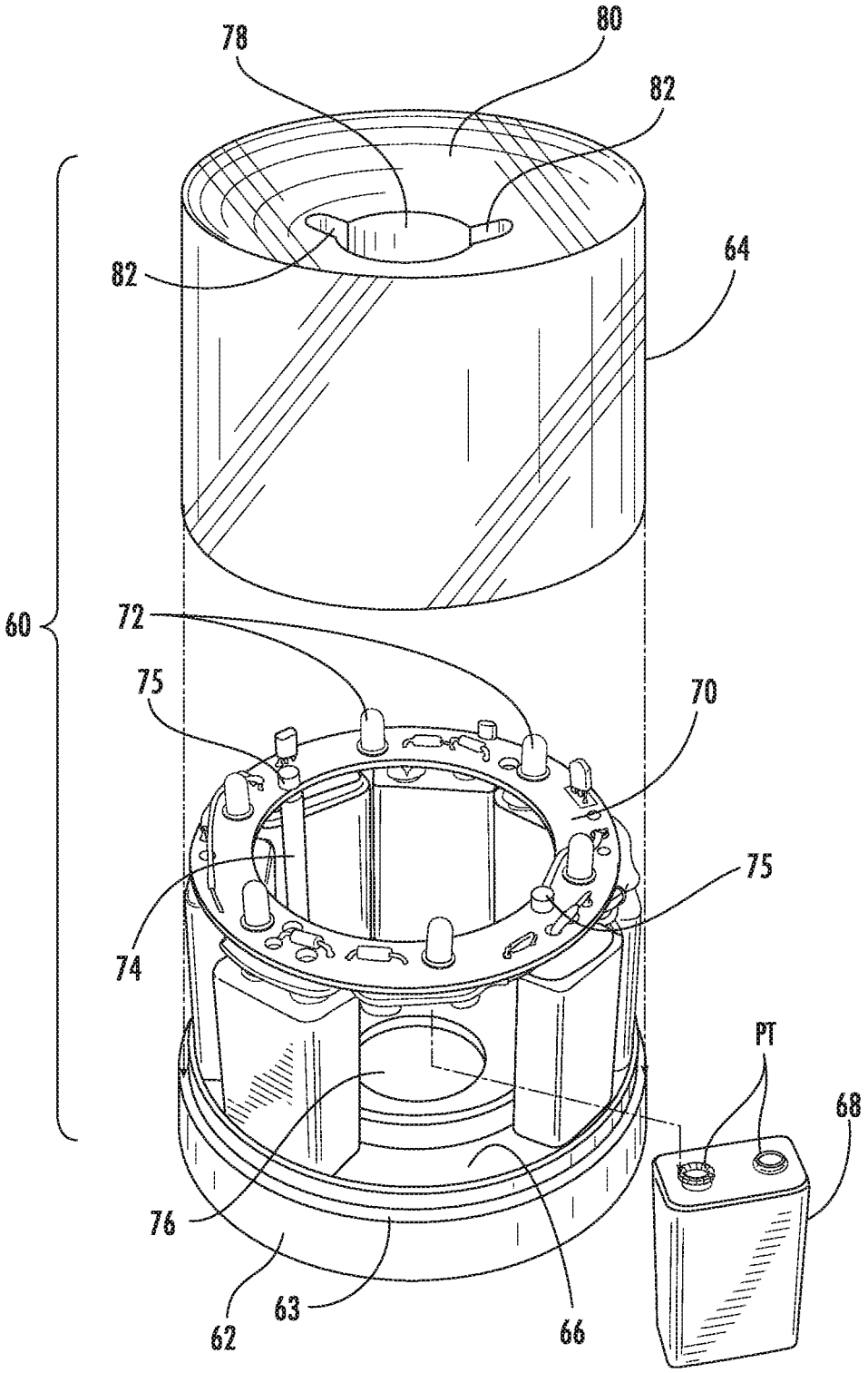
FIG. 9 is an exploded perspective view showing an interior core of the putting cup of FIG. 8 according to an exemplary embodiment of the present invention.

FIG. 9 is an exploded perspective view showing the interior core 60 of the putting cup 30 of FIG. 8 according to an exemplary embodiment of the present invention. As shown herein, the interior core 60 comprises an annular base 62 and a cylindrical cover 64 that is secured onto the base 62. The base 62 and the cover 64 are each made of a relatively lightweight, yet sturdy, material that is sufficiently rigid and resistant to adverse environmental conditions, such as moisture, salt air and airborne chemicals. For example, the base 62 and the cover 64 may be made of a rigid plastic material, such as a thermoplastic material. The base 62 may be made of an opaque plastic material. In one embodiment, the cover 64 is made of a plastic material that is opaque or at least translucent. Preferably, however, the cover 64 is made of a plastic material that is essentially transparent. In an advantageous embodiment, the cover 64 is made of a transparent thermoplastic polymer, such as polycarbonate, PMMA (Acrylic), clear polyethylene terephthalate (PET) or clear polyvinyl chloride (PVC).

By way of example and not limitation, the base 62 and the cover 64 may be secured together by an interference fit, such that simultaneously pressing and turning (rotating) the cover 64 relative to the base 62 secures the cover 64 onto the base 62. Similarly, simultaneously lifting and turning (rotating) the cover 64 relative to the base 62 removes the cover 64 from the base 62. Alternatively, or additionally, an O-ring 63 made of a generally resilient material, such as rubber or soft plastic, may be disposed on a circumferential outer periphery of the base 62 so as to provide a watertight seal between an inner wall of the cover 64 and the base 62. Conversely, an O-ring (not shown) made of a generally resilient material, such as rubber of soft plastic, may be disposed within a groove (not shown) formed in the inner wall of the cover 64 so as to provide a watertight seal between the outer periphery of the base 62 and the inner wall of the cover 64. Alternatively, the cover 64 may be permanently secured onto the base 62 for example by plastic welding, fusion, or adhesive glue suitable for adhering plastic materials to one another.

Regardless, the base 62 defines an upper surface 66 configured to support a plurality of batteries 68 for providing electrical power to electronics in the form of a printed circuit board (PCB) 70 positioned above the batteries 68. In one embodiment, each of the batteries 68 is a 9 volt battery. As shown herein, the PCB 70 is at least semi-annular, and more preferably, is ring-shaped. PCB 70 comprises a conventional power supply circuit (not shown) and a conventional processor circuit (not shown) in a known manner. The PCB 70 further comprises a plurality of sources of visible light 72 that are electrically coupled to the power supply and the processor circuit. In one embodiment, the sources of visible light electrically coupled to the PCB 70 are in the form of one or more light-emitting-diodes (LEDs) 72. In an advantageous embodiment, the LEDs 72 are spaced circumferentially around an upper surface of the ring-shaped PCB 70. When the power supply circuit of PCB 70 is activated, the processor circuit directs electrical power to each LED 72 so as to illuminate the interior core 60. More particularly, the LEDs 72 provide a visible light that projects upwardly and outwardly through the transparent cover 64 of the interior core 60. In one embodiment, the LEDs 72 project a visible light having a predetermined color corresponding to the desired color of one of the putting cups 30 on the putting green 20 of the golf putting game described herein.

If desired, the illumination of the putting cup 30, for example the activation (on-off), the intensity (brightness) and/or the duration (timing) of the illumination, may be controlled wirelessly using wireless communications, such as a Radio Frequency (RF), Bluetooth or Near Field Communication (NFC) wireless communications in a known manner. In one embodiment, the wireless transmission is provided by a Smartphone having a mobile application for wireless communication with a wireless transceiver (not shown) provided within the interior core 60 of each putting cup 30. The mobile application may also acquire data from the wireless transceiver relating to the putting cup 30, such as identification of the interior core 60 disposed within the putting cup 30 and the remaining battery life of the batteries 68 electrically coupled to the PCB 70 of the interior core 60.

The cover 64 of the interior core 60 defines a generally hollow interior compartment that houses the electronic components of the interior core 60, namely the batteries 68, the PCB 70 and the LEDs 72 of the putting cup 30. The PCB 70 may be supported with mating contacts directly on the negative and positive power terminals PT of the batteries 68. Alternatively, a plurality of stand-offs 74 may be provided that extend between the base 62 and the PCB 70. As shown in FIG. 9, at least a pair of elongate stand-offs 74 embedded in the base 62 extend upwardly from the upper surface 66 of the base 62 and through the PCB 70. Preferably, at least the upper ends of the stand-offs 74 are externally threaded to receive corresponding internally threaded stand-off caps 75 to position the PCB 70 above and adjacent to the power terminals PT of the batteries 68.

It has been determined that a 9 volt lithium polymer rechargeable battery manufactured by TD HiTech Energy Inc. of Hsinchu City, Taiwan and commercially available from GN Batteries & Electronics Inc. of Walnut, Calif. USA is particularly suitable for use with the interior core 60 of the putting cup 30. One or more 9 volt lithium polymer rechargeable batteries 68 provide a desired intensity (brightness) of the LEDs 72 without appreciable loss over the duration of the battery life for a suitable run-time of the LEDs 72 before needing to recharge the batteries 68. It has also been determined that electrically connecting the batteries 68 in parallel increases the battery life between recharges, and consequently, the run-time of the LEDs 72. It has further been determined that the battery life of the batteries 68 may be significantly increased, for example at least doubled, by providing a power interrupt circuit on the PCB 70 that intermittently interrupts power to the LEDs 72 so that the LEDs 72 imperceptibly blink up to 50,000 times per minute.

The base 62 has a central opening 76 formed therethrough and the cover 64 has a corresponding central opening 78 formed therethrough. The openings 76, 78 of the base 62 and the cover 64, respectively, are each disposed inwardly and centrally of the batteries 68 and the ring-shaped PCB 70. With the cover 64 secured onto the base 62, the opening 78 of the cover 64 is aligned and in direct communication with the opening 76 of the base 62. Furthermore, the upper surface 80 of the cover 64 defines a cone-shape that slopes inwardly and downwardly from the circumferential outer periphery of the cover 64 to the central opening 78, preferably at a United States Golf Association (USGA) regulation angle. Consequently, the central opening 78 in the cover 64 and the central opening 76 in the base 62 provide a drain for passing water, moisture and small debris into the ground beneath the putting cup 30 when the interior core 60 is inserted into an exterior housing 31 disposed within a recess formed in a putting surface 21 of a putting green 20. The cover 64 also has one or more indentations, projections or the like 82 that extend outward radially from the central opening 78. The opening 78 and recesses 82 are configured to receive a corresponding tool (not shown) for inserting the interior core 60 into the exterior housing 31 and for removing the interior core 60 from the exterior housing 31, as will be described hereafter. The opening 78 and recesses 82 on the cover 64 of the interior core 60 may further receive and prevent rotation of an optional flagstick or similar marker removably disposed within the putting cup 30. However, the use of a flagstick or similar marker is discouraged in the present golf putting game due to the likelihood of malicious vandalism and/or damage to the putting surface 21 of the putting green 20.

Figure 10:
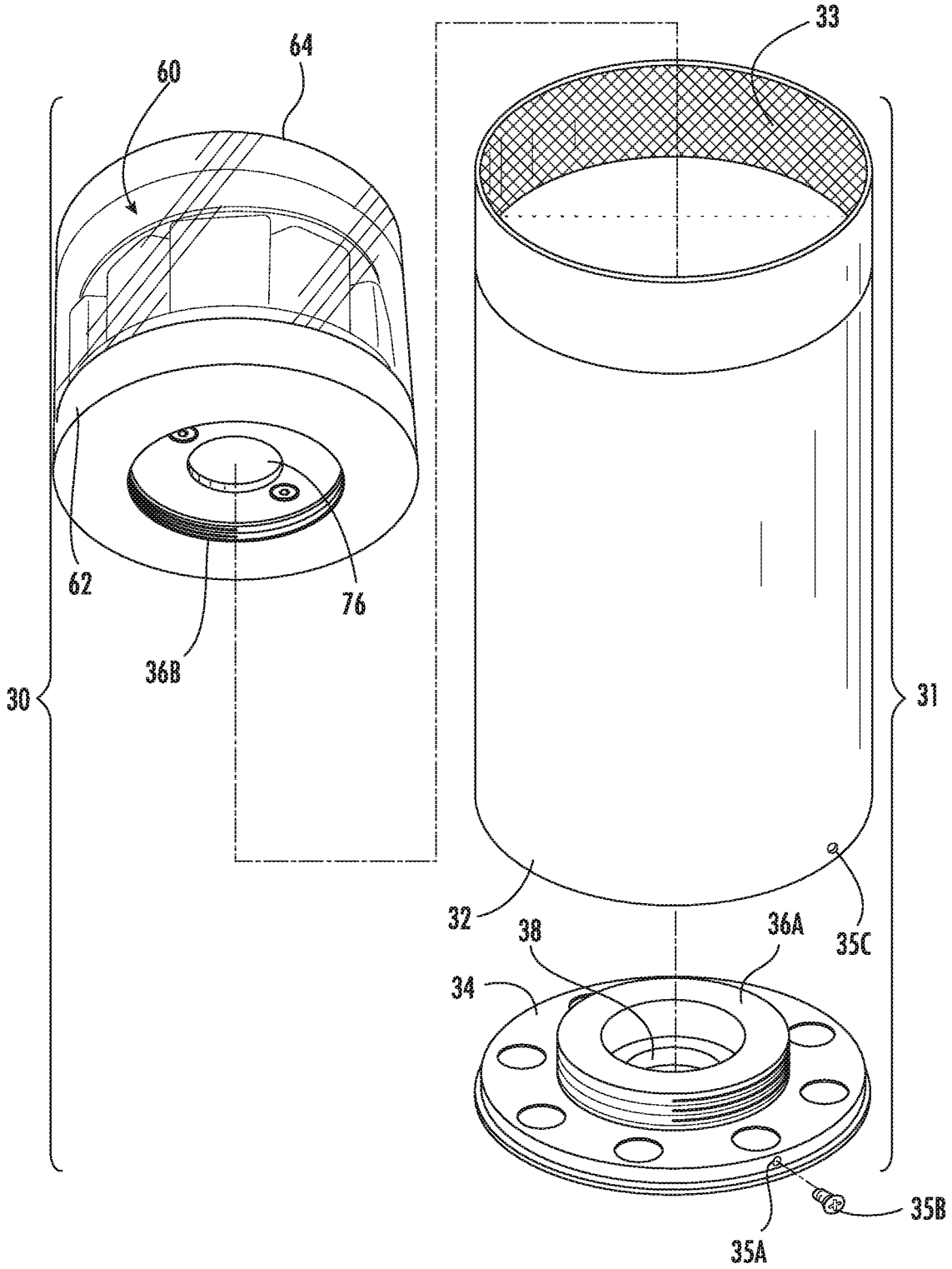
FIG. 10 is an exploded view of the putting cup of FIG. 8.

FIG. 10 is an exploded perspective view of the entire putting cup 30 of FIG. 8. FIG. 10 illustrates the assembly of the putting cup 30 and the removable attachment of the interior core 60. The exterior housing 31 comprises a thin-walled cylindrical sleeve 32, an optional thin-walled cylindrical upper ring 33, and an annular lower end cap 34. The sleeve 32 is preferably made of a lightweight yet sufficiently rigid plastic, composite or metal material, such as aluminum. The optional upper ring 33 is likewise made of a lightweight yet sufficiently rigid plastic, composite or metal material. The sleeve 32 and the upper ring 33 may be provided with a reflective inner surface. In one embodiment, the inner surface of the ring 33 has a reflective color to match the color illuminated by the LEDs 72 of the interior core 60 disposed within the exterior housing 31 of the putting cup 30. The inner surface of the ring 33 may be coated or sprayed with a luminescent, fluorescent or phosphorescent paint of the desired color. Alternatively, the inner surface of the ring 33 may be lined with a colored phosphorous vinyl tape of the type available from the 3M Company of Maplewood, Minn.

The upper ring 33 may be integrally formed with the sleeve 32 or permanently affixed to the sleeve 32. Preferably, however, the upper ring 33 is removably attached to the sleeve 32 so that an upper ring 33 is interchangeable with a sleeve 32. This embodiment is particularly useful for the HiLo golf putting game described herein when an interior core 60 illuminating one color is removed from an exterior housing 31 of a putting cup 30 disposed within the putting surface 21 on a putting green 20 and replaced with an interior core 60 illuminating another color, while the exterior housing 31 of the putting cup 30 remains disposed within the putting surface 21 at the same location on the putting green 20. The upper ring 33 may be detached from the sleeve 32 and the color of the upper ring 33 can be matched with the color illuminated by the LEDs 72 of the replacement interior core 60 inserted into and attached to the exterior housing 31 of the putting cup 30.

The lower end cap 34 may be permanently affixed to the sleeve 32 of the exterior housing 31. In the embodiment shown in FIG. 10, a circumferential outer periphery of the end cap 34 defines a stepped recess having an internally threaded insert 35A. The insert 35A extends radially inward and receives a set screw 35B within an opening 35C formed through the sleeve 32 to removably secure the end cap 34 onto the sleeve 32. The lower end cap 34 further comprises an externally threaded annular receiver 36A configured to receive an internally threaded cylindrical receiver 36B provided on the underside of the base 62 of the interior core 60. The externally threaded annular receiver 36A defines a central opening 38 through the end cap 34 that is aligned and in communication with the central openings 76, 78 of the base 62 and the cover 64, respectively, when the interior core 60 is inserted into and attached to the exterior housing 31. The internally threaded cylindrical receiver 36B provided on the base 62 of the interior core 60 is configured to engage with the externally threaded annular receiver 36A of the end cap 34 when the interior core 60 is disposed within the sleeve 32 of the exterior housing 31 of the putting cup 30. As illustrated in FIG. 10, the interior core 60 is inserted into the sleeve 32 of the exterior housing 31 and the annular receiver 36A provided on the end cap 34 of the exterior housing 31 is mated with the cylindrical receiver 36B provided on the base 62 of the interior core 60.

In any event, the interior core 60 is configured to be inserted into and removably attached to the exterior housing 31 of the putting cup 30. Furthermore, the interior core 60 is configured to be removed from the exterior housing 31 without removing the exterior housing 31 disposed within the putting surface 21 of the putting green 20. The removable interior core 60 is particularly advantageous for inserting an interior core 60 having charged batteries 68, for replacing the interior core 60 with an interior core 60 having charged batteries 68, and/or for interchanging the interior core 60 with an interior core 60 having LEDs 72 that illuminate a different color while the exterior housing 31 of the putting cup 30 remains disposed within the putting surface 21 of the putting green 20. Inserting, removing, replacing and interchanging the interior core 60 with the exterior housing 31 of the putting cup 30 disposed within the putting green 20 avoids damage to the putting surface 21 of the putting green 20. In addition, the interchangeable interior core 60 having LEDs 72 that illuminate a visible light having a predetermined color can be readily moved from a putting cup 30 at one location on the putting green 20 to a putting cup 30 at a different location on the putting green 20. The removable, replaceable and interchangeable interior core 60 is particularly useful for easily maintaining and manipulating the putting cups 30 of a golf putting game as described herein. Specifically, a fully-charged or recharged interior core 60 can be readily inserted into a putting cup 30, or an interior core 60 already disposed within the exterior housing 31 of a putting cup 30, can be readily replaced with a fully-charged or recharged interior core 60 without removing the exterior housing 31 from the putting green 20. In addition, the locations of the putting cups 30 on the putting green 20 of a hole 10 of a golf putting game as described herein can be readily reconfigured to vary the layout of the hole 10 and/or the location of the putting cups 30 having different base points corresponding to the predetermined color of the visible light illuminated by the LEDs 72 of the interior core 60 of the putting cups 30.

Regardless of the foregoing detailed description of exemplary embodiments of the inventions, the optimum configuration of the article of manufacture, apparatus, device or system, and the manner of use, operation and steps of the associated methods, as well as reasonable equivalents thereof, are deemed to be readily apparent and understood by those skilled in the art. Accordingly, equivalent relationships to those shown in the accompanying drawing figures and described in the written description are intended to be encompassed by the inventions and the broadest reasonable interpretation of the appended claims, the foregoing being considered as illustrative only of the general concepts and principles of the inventions. Furthermore, as numerous modifications and changes will readily occur to those skilled in the art, the exemplary embodiments are not intended to limit the inventions to the specific configuration, construction, materials, manner of use and operation shown and described herein. Instead, all reasonably predictable and suitable equivalents and obvious modifications to the inventions should be construed as falling within the scope of the inventions as defined by the appended claims given their broadest reasonable construction and interpretation in view of the accompanying written description and drawing figures.

That which is claimed is:

1. A golf putting game, comprising:

at least one putting green defining a putting surface; and a plurality of putting cups with each putting cup positioned at a different location on the putting surface of the putting green;

wherein each putting cup comprises an exterior housing and an interior core that is disposed within the exterior housing and removably attached to the exterior housing, the interior core being removable from the exterior housing with the putting cup disposed within the putting surface of the putting green;

wherein the interior core of each putting cup is illuminated by a different preselected color;

wherein the exterior housing of each putting cup comprises a cylindrical sleeve, an annular lower end cap attached to the sleeve and comprising a first receiver for engaging a second receiver on the interior core to removably attach the interior core to the exterior housing when the second receiver is engaged with the first receiver, and a cylindrical upper ring that is removably attached to the sleeve, the upper ring having a color matching the preselected color that illuminates the interior core of the putting cup.

2. The golf putting game according to claim 1, wherein the interior core of the putting cup comprises a printed circuit board (PCB) and at least one battery electrically coupled to the PCB.

3. The golf putting game according to claim 2, wherein the PCB comprises at least one source of visible light electrically coupled to the PCB for illuminating the interior core of the putting cup.

4. The golf putting game according to claim 3, wherein the at least one source of visible light comprises a light-emitting-diode (LED).

5. The golf putting game according to claim 2, wherein the at least one battery is a rechargeable battery.

6. The golf putting game according to claim 2, wherein the at least one battery is a lithium polymer rechargeable battery.

7. The golf putting game according to claim 1, wherein the interior core comprises a base and a cover, and wherein at least the cover is made of a material that is translucent.

8. The golf putting game according to claim 1, further comprising a putting club and a putting ball that is configured to be struck by the putting club.

* * * * *